US010699865B2

(12) United States Patent
Lee et al.

(10) Patent No.: US 10,699,865 B2
(45) Date of Patent: Jun. 30, 2020

(54) ELECTROMECHANICAL SWITCH HAVING A MOVABLE CONTACT AND STATIONARY CONTACTS

(71) Applicant: TE CONNECTIVITY CORPORATION, Berwyn, PA (US)

(72) Inventors: Albert Yong Lee, Greensboro, NC (US); Roger Lee Thrush, Clemmons, NC (US)

(73) Assignee: TE Connectivity Corporation, Berwyn, PA (US)

( * ) Notice: Subject to any disclaimer, the term of this patent is extended or adjusted under 35 U.S.C. 154(b) by 136 days.

(21) Appl. No.: 15/960,619

(22) Filed: Apr. 24, 2018

(65) Prior Publication Data

US 2019/0326084 A1 Oct. 24, 2019

(51) Int. Cl.
*H01H 50/54* (2006.01)
*H01H 50/12* (2006.01)
(Continued)

(52) U.S. Cl.
CPC ..... *H01H 50/546* (2013.01); *H01H 47/22* (2013.01); *H01H 50/12* (2013.01); *H01H 50/18* (2013.01); *H01H 50/36* (2013.01); *H01H 51/27* (2013.01); *H01H 2203/048* (2013.01); *H01H 2205/002* (2013.01)

(58) Field of Classification Search
CPC ..... H01H 2203/048; H01H 2205/002; H01H 47/22; H01H 50/12; H01H 50/18; H01H 50/36; H01H 50/546; H01H 51/27
See application file for complete search history.

(56) References Cited

U.S. PATENT DOCUMENTS 5,424,700 A 6/1995 Santarelli
7,157,996 B2 1/2007 Enomoto et al.
(Continued)

FOREIGN PATENT DOCUMENTS

DE 10 2008 002114 A1 12/2009
KR 20170079601 A 7/2017
(Continued)

OTHER PUBLICATIONS

Machine translation of Valeo [WO 2013093372], Jun. 27, 2013 (Year: 2013).*

(Continued)

*Primary Examiner* — Bernard Rojas

(57) ABSTRACT

Electromechanical switch includes first and second stationary contacts. Each of the first and second stationary contacts has a respective mating end. The electromechanical switch also includes a movable contact having first and second contact zones. The first and second contact zones are separate regions of the movable contact that are operable to be covered by the respective mating ends of the first and second stationary contacts, respectively. Each of the first and second contact zones has a mating surface and a corresponding recess that divides at least a portion of the mating surface. Each of the respective mating ends is configured to extend across the corresponding recess and engage the corresponding mating surface on opposite sides of the corresponding recess. The corresponding recess has a depth that extends only partially into the movable contact.

20 Claims, 5 Drawing Sheets

(51) Int. Cl.

| | |
|---|---|
| ***H01H 50/18*** | (2006.01) |
| ***H01H 47/22*** | (2006.01) |
| ***H01H 50/36*** | (2006.01) |
| *H01H 51/27* | (2006.01) |

(56) References Cited

U.S. PATENT DOCUMENTS

| | | | | |
|---|---|---|---|---|
| 7,199,687 | B2 | 4/2007 | Maruhashi et al. | |
| 7,365,280 | B2 | 4/2008 | Nishikawa et al. | |
| 7,982,564 | B2 | 7/2011 | Farrar et al. | |
| 8,274,345 | B2 | 9/2012 | Sugisawa | |
| 8,354,905 | B2 | 1/2013 | Eum | |
| 8,552,823 | B2 | 10/2013 | Isonaga | |
| 9,064,664 | B2 | 6/2015 | Yamamoto et al. | |
| 9,679,725 | B2 | 6/2017 | Parl | |
| 10,102,993 | B2 * | 10/2018 | Guignot | H01H 1/2008 |
| 2013/0229247 | A1 | 9/2013 | Yokoyama et al. | |
| 2015/0187518 | A1 * | 7/2015 | Molyneux | H01H 1/06 335/154 |
| 2015/0194284 | A1 | 7/2015 | Uruma et al. | |
| 2015/0303016 | A1 | 10/2015 | Sprague et al. | |
| 2016/0042881 | A1 * | 2/2016 | Nishida | H01H 1/06 335/196 |
| 2016/0155592 | A1 | 6/2016 | Ito et al. | |

FOREIGN PATENT DOCUMENTS

| | | | |
|---|---|---|---|
| WO | 2005043571 | A1 | 5/2005 |
| WO | 2013093372 | A1 | 6/2013 |

OTHER PUBLICATIONS

International Search Report, International Application No. PCT/IB2019/053120, dated Apr. 16, 2019.

* cited by examiner

ELECTROMECHANICAL SWITCH HAVING A MOVABLE CONTACT AND STATIONARY CONTACTS

BACKGROUND

The subject matter herein relates generally to electromechanical switches (e.g., contactors or relays) that control a flow of electrical power through a circuit.

Electromechanical switches may be used in a number of application in which it is desirable to selectively control the flow of electrical power. Electromechanical switches, such as contactors or relays, may include a movable contact and a plurality of stationary contacts. The movable contact is selectively moved to engage or disengage the stationary contacts. When the movable contact is engaged to the stationary contacts, electrical power may flow through the contacts.

For certain applications, an audible noise is generated along the interfaces between the movable contact and the stationary contacts. For example, an electric vehicle uses an electric vehicle battery (EVB) or a traction battery to power the vehicle. Such batteries may include individual cells having one or more contactors. When an individual presses the accelerator pedal, the movable contact of the contactor is moved to engage the stationary contacts. If the individual rapidly and/or deeply presses the accelerator pedal to accelerate the vehicle more quickly, a surge of current flows through the movable contact and the stationary contacts. This surge of current may cause the movable contact to oscillate and generate the audible noise. The audible noise can be distracting or annoying to drivers. In addition to the audible noise, a large amount of thermal energy may be generated within the contacts that has undesirable effects.

Accordingly, a need remains for an electromechanical switch in which the movable contact and the stationary contacts reduce the audible noise and, optionally, reduce an amount of thermal energy generated within the contacts.

BRIEF DESCRIPTION

In at least one embodiment, an electromechanical switch is provided that includes first and second stationary contacts. Each of the first and second stationary contacts has a respective mating end. The electromechanical switch also includes a movable contact having first and second contact zones. The first and second contact zones are separate regions of the movable contact that are operable to be covered by the respective mating ends of the first and second stationary contacts, respectively. Each of the first and second contact zones has a mating surface and a corresponding recess that divides at least a portion of the mating surface. Each of the respective mating ends is configured to extend across the corresponding recess and engage the corresponding mating surface on opposite sides of the corresponding recess. The corresponding recess has a depth that extends only partially into the movable contact.

In some aspects, the movable contact includes opposite mating and mounting sides and first and second contact ends in which each of the mating and mounting sides extends between the first and second contact ends. The mating side includes the first and second contact zones. Optionally, the movable contact has a center of mass (COM) that is closer to the mounting side than the mating side.

In some aspects, the movable contact is symmetrically shaped with respect to a first plane that extends through the COM and between the first and second contact zones and with respect to a second plane that extends through the COM between the first and second contact ends.

In some aspects the mounting side extends away from the mating side as the movable contact extends from the first contact end toward a center of the movable contact and extends away from the mating side as the movable contact extends from the second contact end toward the center of the movable contact.

In some aspects, the movable contact has a thickness measured between the mating and mounting sides. The thickness of the movable contact is greater at a center of the movable contact.

In some aspects, the movable contact also includes opposite broad sides that extend between the first and second contact ends and between the mounting and mating sides. The mounting side is shaped to center a mass of the movable contact.

In some aspects, the mating side includes a pair of gutters and a platform surface defined between the gutters. The platform surface includes the first and second contact zones. Optionally, the platform surface has a platform width defined between the gutters. The platform width is sized relative to the respective mating ends such that the respective mating ends clear the platform surface and extend over at least one of the gutters. Optionally, the platform surface extends continuously across the mating side between the first and second contact ends.

In some aspects, the corresponding recess is the only recess that is entirely covered by the respective mating end.

In some aspects, the corresponding recess of the first contact zone opens to a first contact end of the movable contact and the corresponding recess of the second contact zone opens to a second contact end of the movable contact.

In at least one embodiment, a power circuit is provided that includes an electromagnetic driving unit and a switch operably coupled to the electromagnetic driving unit. The power circuit also includes an electromechanical switch having first and second stationary contacts and a movable contact. Each of the first and second stationary contacts have a respective mating end. The movable contact has first and second contact zones. The first and second contact zones are separate regions of the movable contact that are operable to be covered by the respective mating ends of the first and second stationary contacts, respectively. The movable contact includes opposite mating and mounting sides and also includes first and second contact ends in which each of the mating and mounting sides extends between the first and second contact ends. The mating side includes the first and second contact zones. Each of the first and second contact zones has a corresponding mating surface and a corresponding recess that divides at least a portion of the corresponding mating surface. Each of the respective mating ends is configured to extend across the corresponding recess and engage the corresponding mating surface on opposite sides of the corresponding recess. The corresponding recess has a depth that extends only partially into the movable contact. The switch is operably coupled to the movable contact. The electromagnetic driving unit is operable to move the switch between at least two different positions to connect and disconnect a power supply.

DETAILED DESCRIPTION

Figure 1:
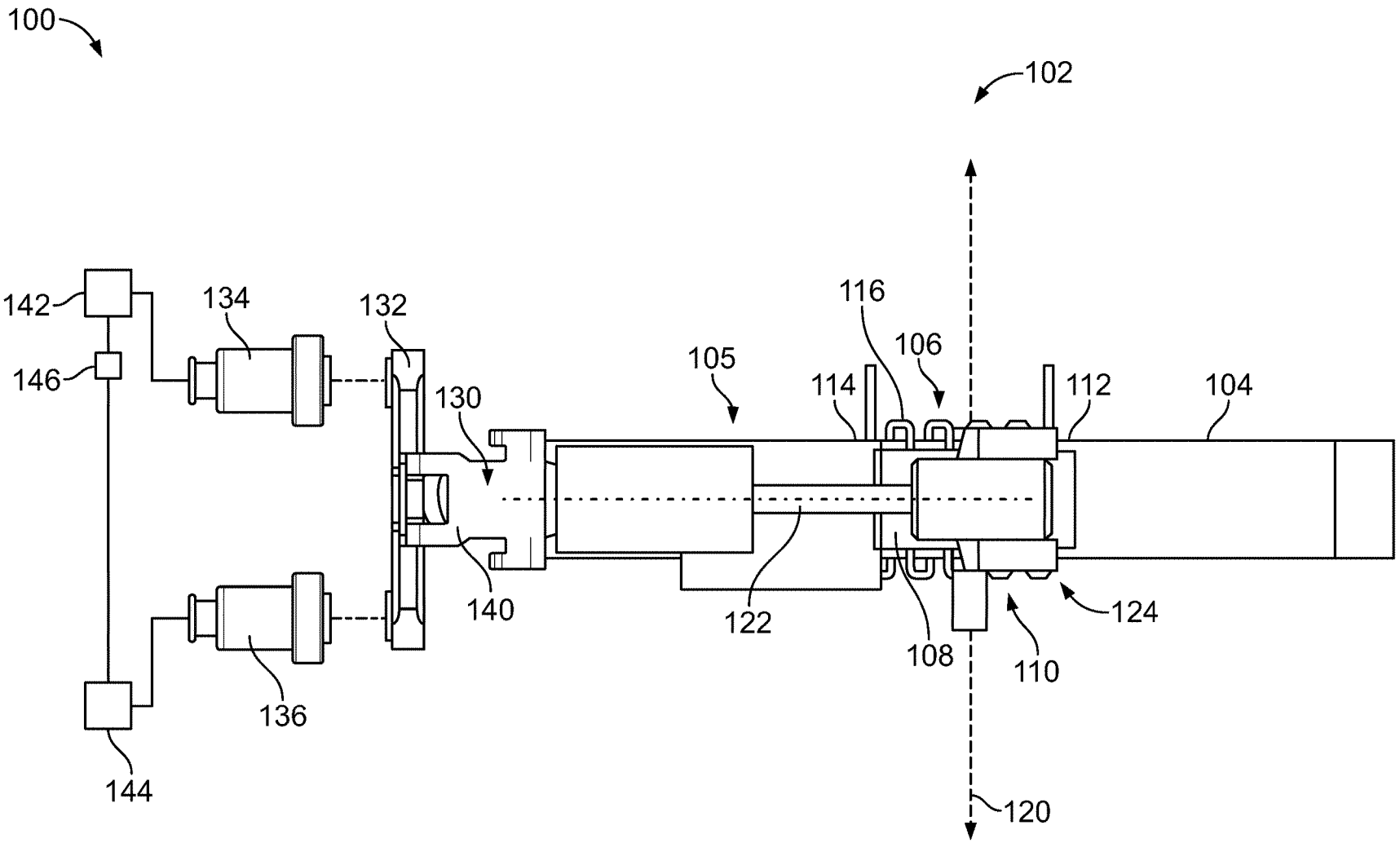
FIG. 1 is a side view of a power circuit formed in accordance with an embodiment that includes an electromechanical switch.

FIG. 1 is a side view of a power circuit 100 formed in accordance with an embodiment that includes an electromechanical switch 102. The electromechanical switch 102 may include a yoke 104, an electromagnetic driving unit 106, and a circuit switch 108. Although not shown, the yoke 104 may be an elongated bar that is wrapped about such that end portions 112, 114 of the elongated bar for a switch-receiving space 110 therebetween. The electromagnetic driving unit 106 is in the form of a coil 116 that is wrapped around the yoke 104 at a position opposite the switch-receiving space 110. The circuit switch 108 is disposed within the switch-receiving space 110 and may be, for example, a rotating armature that is rotatable about a rotational axis 120.

The electromechanical switch 102 also includes a linkage assembly 105 that mechanically interconnects the circuit switch 108 and a movable contact 132. The linkage assembly 105 includes one or more rods 122 and a hinge 124 that is connected to the one or more rods 122. The hinge 124 is operable to rotate about a hinge axis that may be parallel to the rotational axis 120. As shown, the electromechanical switch 102 also includes a contact carrier 130, the movable contact 132, and a pair of stationary contacts 134, 136. The contact carrier 130 has one or more supporting portions 140.

The electromechanical switch 102 is shown in an open position in which the movable contact 132 is not engaged with the stationary contacts 134, 136 such that an electrical connection is not established. The power circuit 100 also includes a power supply 142 and an electrical sub-assembly 144. The power supply 142 may be a battery for an electric vehicle. In FIG. 1, the power supply 142 is disconnected from the electrical sub-assembly 144. An electrical switch 146 may provide a mechanical circuit disconnection and/or an electrical circuit disconnection. The circuit switch 108 may be activated to move between two different positions or states. In one position, which may be referred to as a disengaged position, the movable contact 132 is not engaged with the stationary contacts 134, 136. In the other position, which may be referred to as a mating position, the movable contact 132 engages each of the stationary contacts 134, 136 so that electrical power may flow through the electromechanical switch 102. To move between the positions, the electromagnetic driving unit 106 may be energized or de-energized by the coil 116. For example, when energized, the linkage assembly 105 may drive the movable contact 132 toward the stationary contacts 134, 136. When de-energized, the linkage assembly 105 may drive the movable contact 132 away from the stationary contacts 134, 136.

Figure 2:
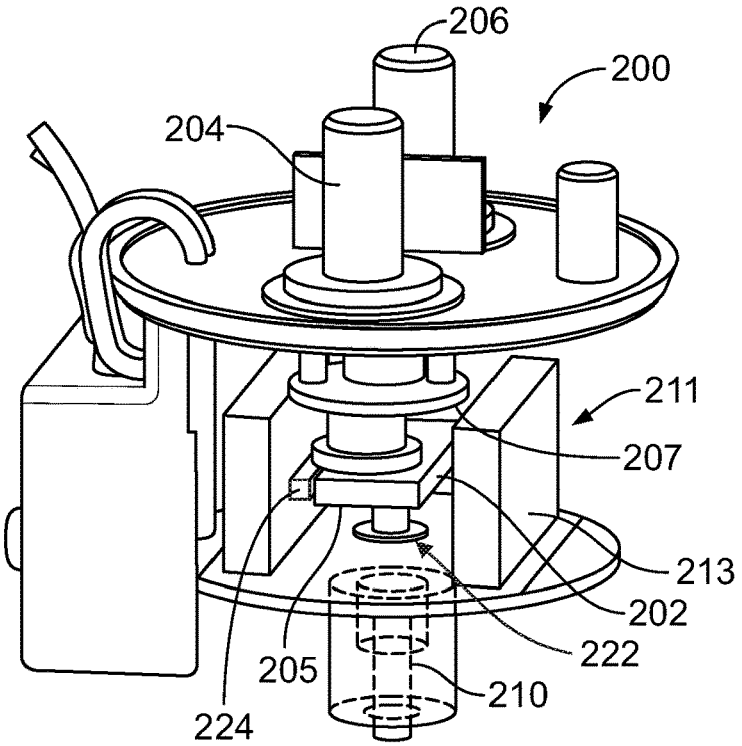
FIG. 2 is a perspective view of a portion of an electromechanical switch formed in accordance with an embodiment that may be used with the power circuit of FIG. 1.
Figure 3:
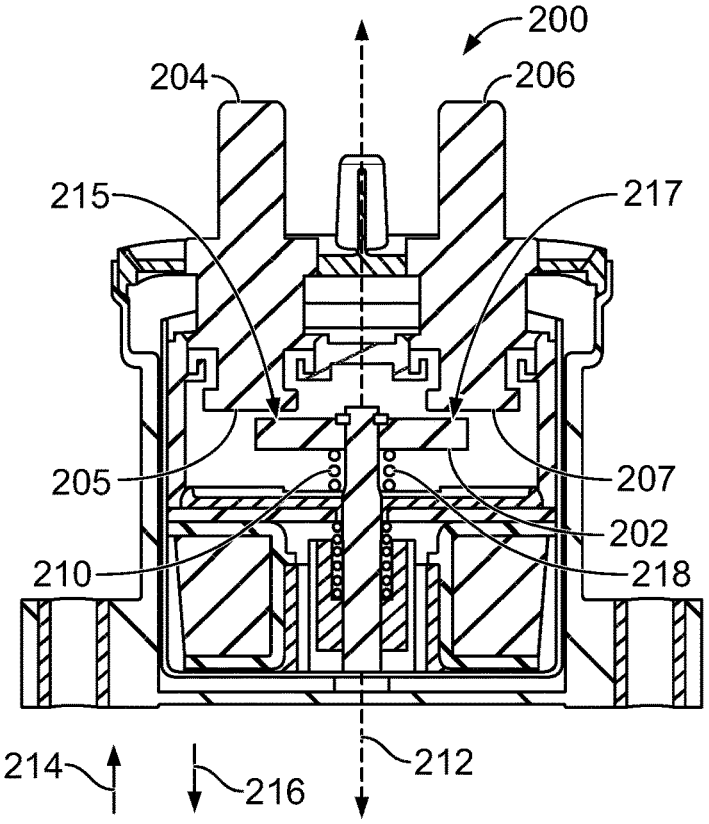
FIG. 3 is a cross-section of the electromechanical switch of FIG. 2.

FIGS. 2 and 3 are a perspective view and a cross-sectional view of a portion of an electromechanical switch 200 formed in accordance with an embodiment. The electromechanical switch 200 may replace the electromechanical switch 102 in FIG. 1 and form a portion of the power circuit 100 (FIG. 1). As shown, the electromechanical switch 200 includes a movable contact 202 and first and second stationary contacts 204, 206. Optionally, the electromechanical switch 200 may include one or more additional movable contacts. Optionally, the electromechanical switch 200 may include one or more additional stationary contacts.

Figure 4:
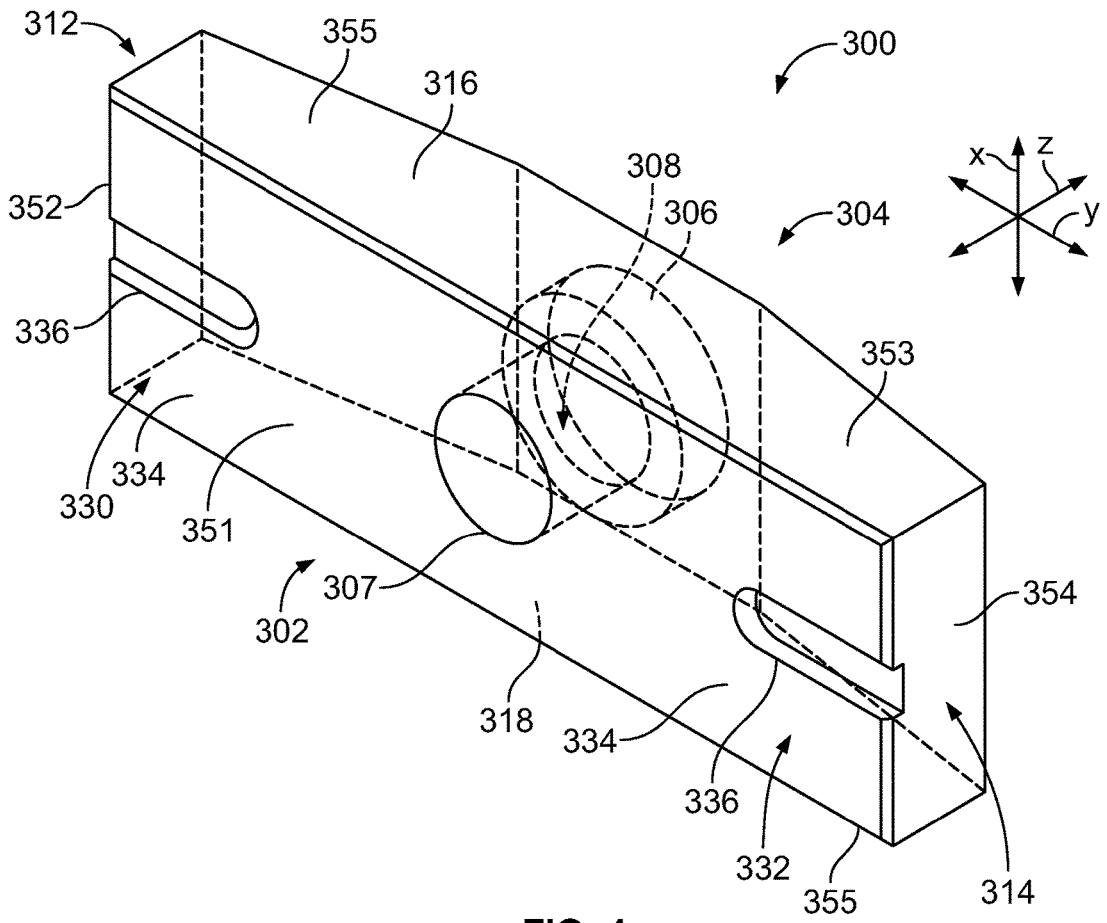
FIG. 4 is an isolated perspective view of a movable contact that may be used with the electromechanical switch of FIG. 2.

The first and second stationary contacts 204, 206 have respective mating ends 205, 207. The movable contact has first and second contact zones 215, 217. The first and second contact zones 215, 217 are separate regions of the movable contact 202 that are configured to be covered by the mating ends 205, 207, respectively, when the movable contact 202 and the first and second stationary contacts 204, 206 are engaged. The movable contact 202 may be similar or identical to the movable contact 300 (FIG. 4). As described herein, each of the first and second contact zones 215, 217 has a mating surface and a corresponding recess that divides at least a portion of the mating surface. Each of the mating ends 205, 207 is configured to extend across the corresponding recess and engage the corresponding mating surface on opposite sides of the corresponding recess. In some embodiments, one or both of the mating ends 205, 207 may extend entirely across the corresponding recess and engage the corresponding mating surface on opposite sides of the corresponding recess.

Also shown in FIGS. 2 and 3, the electromechanical switch 200 includes a support rod 210 that is coupled to the movable contact 202. The support rod 210 may form a portion of a linkage assembly, such as the linkage assembly 105 (FIG. 1), that is operably coupled to a circuit switch (not show), such as the circuit switch 108 (FIG. 1).

The electromechanical switch 200 includes a contact carrier 211. The contact carrier 211 includes a pair of supporting portions 213 that are spaced apart to define a contact space 222 therebetween. The contact carrier 211 also includes one or more alignment projections 224. The alignment projections 224 may be, for example, ribs that engage the movable contact 202 if the movable contact 202 rotates about the support rod 210.

With respect to FIG. 3, the support rod 210 is operable to move bi-directionally along an axis 212 toward and away from the stationary contacts 204, 206. The axis 212 extends through a center of the support rod 210 along a length of the support rod 210. More specifically, when the support rod 210 moves in a mating direction 214, the movable contact 202 engages the mating ends 205, 207, thereby allowing electrical power to flow therethrough. When the support rod 210 moves in a disconnect direction 216, which is opposite the mating direction 214, the movable contact 202 disengages from the mating ends 205, 207, thereby disconnecting the electrical power. In some embodiments, one or more biasing members 218 (e.g., springs) may be used to facilitate the mating and/or disconnecting operations.

FIGS. 4-7 illustrate different views of a movable contact 300 that may be used with the electromechanical switch 200 (FIG. 2). In the illustrated embodiment, the movable contact 300 is generally block-shaped with a plurality of planar exterior surfaces. In other embodiments, however, the movable contact 300 may have different shapes and/or exterior surfaces that are non-planar.

As shown, the movable contact 300 is oriented with respect to mutually perpendicular X, Y, and Z axes. The movable contact 300 includes a mating side 302 and a mounting side 304. The mating side 302 is operable to engage and disengage stationary contacts, such as the stationary contacts 204, 206 (FIG. 2). The mating side 302 and the mounting side 304 face in generally opposite directions along the Z axis. The mounting side 304 is operable to receive a support rod, such as the support rod 210 (FIG. 2). More specifically, the mounting side 304 includes an opening 306 to a cavity 308 that receives the support rod. The cavity 308 may extend only partially through or entirely through the movable contact 300. For embodiments in which the cavity 308 extends entirely through the movable contact 300, the mating side 302 includes an opening 307.

The mating side 302 has first and second contact zones 330, 332. The first and second contact zones 330, 332 are separate regions of the movable contact 300 that are configured to be covered by mating ends of corresponding stationary contacts. For example, the first contact zone 330 may be aligned with and engage or be spaced apart from the mating end 205 (FIG. 2). The second contact zone 332 may be aligned with and engage or be spaced apart from the mating end 207 (FIG. 2).

As shown in FIG. 4, each of the first and second contact zones 330, 332 has a mating surface 334 and a corresponding recess 336 that divides at least a portion of the mating surface 334. In certain embodiments, each of the mating ends of the stationary contacts is configured to extend entirely across the corresponding recess 336 and engage the corresponding mating surface 334 on opposite sides of the recess 336. The recess 336 has a depth 338 (FIG. 5 or FIG. 7) that extends only partially into the movable contact 300 along the Z axis. In the illustrated embodiment, each of the recesses 336 is the only recess within the corresponding contact zone. It is contemplated, however, that the contact zones may include more than one recess (e.g., two or three recesses). In the illustrated embodiment, the recess 336 of the first contact zone 330 opens to a first contact end 312 of the movable contact 300, and the recess 336 of the second contact zone 332 opens to a second contact end 314 of the movable contact 300.

Figure 5:
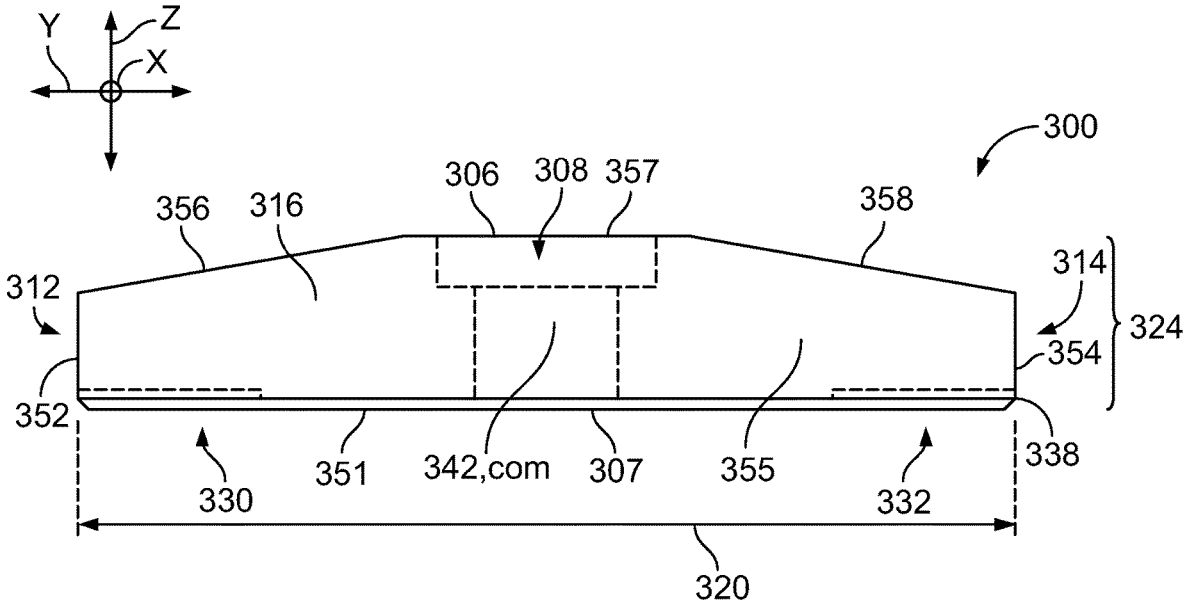
FIG. 5 is a side view of the movable contact that may be used with the electromechanical switch of FIG. 2.
Figure 6:
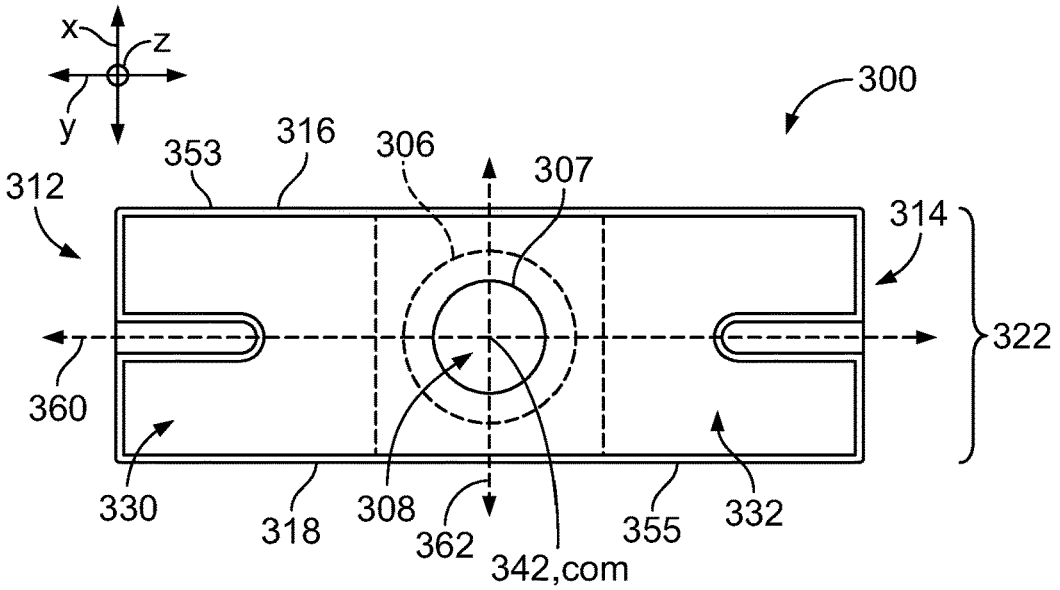
FIG. 6 is a top view of the movable contact that may be used with the electromechanical switch of FIG. 2.

With respect to FIGS. 5 and 6, the first and second contact ends 312, 314 that face in generally opposite directions along the Y axis. The movable contact 300 also includes longitudinal broad sides 316, 318. The first and second contact ends 312, 314 extend between the broad sides 316, 318 along the X axis. A length 320 (shown in FIG. 5) of the movable contact 300 extends between the first and second contact ends 312, 314. The length 320 is measured along the Y axis. By way of example, the length 320 may be between 25 and 40 millimeters (mm) or, in particular embodiments, between 30 and 36 mm. A width 322 (shown in FIG. 6) of the movable contact 300 extends between the first and second broad sides 316, 318. The width 322 is measured along the X axis. By way of example, the width 322 may be between 5 and 20 mm or, in particular embodiments, between 8 and 14 mm. In the illustrated embodiment, the length 320 is essentially uniform and the width 320 is essentially uniform throughout the movable contact 300. More specifically, a series of cross-sections of the movable contact 300 taken perpendicular to the Y axis have the same width 322. A series of cross-sections of the movable contact 300 taken perpendicular to the X axis have the same length 320.

Figure 7:
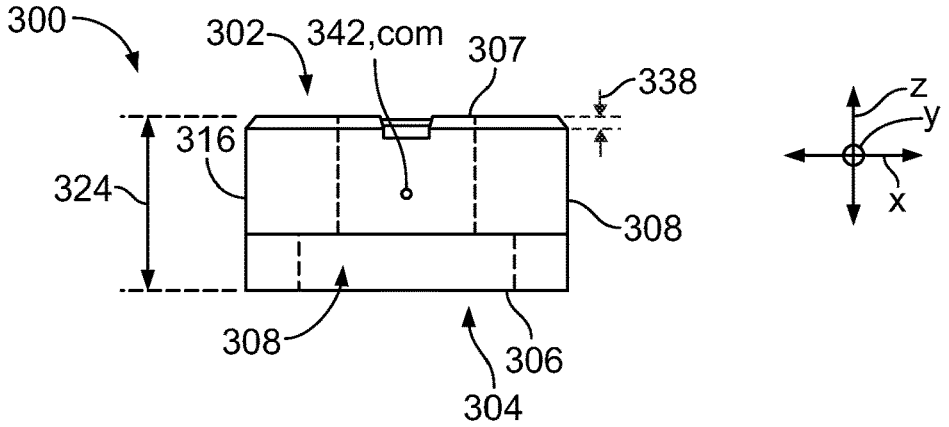
FIG. 7 is an end view of the movable contact that may be used with the electromechanical switch of FIG. 2.

With respect to FIGS. 5 and 7, a thickness or height 324 extends between the mating and mounting sides 302, 304. The thickness 324 of the movable contact 300, however, is not uniform and changes. The thickness may vary in a linear manner or in a non-linear manner (e.g., logarithmic, exponential, or stepwise). The thickness 324 may be greater at a center 342 of the movable contact 300. The center 342 has coordinates that correspond to a midpoint along the length 320, a midpoint along the width 322, and a midpoint along the thickness 324. The center 342 is located within the cavity 308. As shown in FIG. 5, the thickness 324 increases as the movable contact 300 extends from the first contact end 312 toward the center 342 and increases as the movable contact 300 extends from the second contact end 314 toward the center 342. In the illustrated embodiment, the thickness 324 increases in a linear manner. In other embodiments, however, the thickness 324 may increase in a non-linear manner.

The mating side 302, the mounting side 304, or both may be shaped to center a mass of the movable contact. More specifically, the mating side 302, the mounting side 304, or both may be shaped to increase a proportion of the total mass of the movable contact 300 that is closer to the center 342 or the axis 212 (FIG. 3). With more of the total mass closer to the axis 212 or the center 342, the movable contact 300 may be easier to control or balance.

The movable contact 300 may also be characterized as having a plurality of planar exterior surfaces 351-358. The planar exterior surface 351 corresponds to the mating side 302. The planar exterior surfaces 352, 354 correspond to the contact ends 312, 314, respectively. The planar exterior surfaces 353, 355 correspond to the opposite broad sides 316, 318, respectively.

With respect to FIG. 5, the planar exterior surfaces 356-358 collectively form the mounting side 304. The planar exterior surface 357 includes the opening 306. The planar exterior surfaces 356, 358 are oriented at a non-orthogonal angle with respect to the planar exterior surface 357. It should be understood, however, that other embodiments may include exterior surfaces that are not planar.

The planar exterior surfaces 356, 358 are oriented so that the thickness 324 increases as the planar exterior surfaces 356, 358 extend toward the planar exterior surface 357. More specifically, as the movable contact 300 extends from the first contact end 312 or the second contact end 314 toward the center 342, the mounting side 304 extends away from the mating side 302 in a direction along the Z axis.

In particular embodiments, the movable contact 300 may be configured to have a center of mass (COM) 303 that aligns with an axis of the support rod, such as the axis 212 (FIG. 3), and that is positioned closer to the mounting side 304 than the mating side 302. In the illustrated embodiment, the COM 303 overlaps with the center 342. In alternative embodiments, the COM 303 may align with the axis of the support rod and be positioned closer to the mating side 302 than the mounting side 304.

For embodiments in which the thickness 324 is greater toward the center 342, the movable contact 300 has more material toward the center 342 compared to other known movable contacts. The additional material may absorb more thermal energy that is generated during operation. The larger surface areas of the broad sides 316, 318 proximate to the center 342 may also permit a greater rate of heat dissipation. In such embodiments, the amount of thermal energy dissipated proximate to the first and second contact ends 312, 314 may be reduced, thereby reducing damage or wear to the surrounding environment that may be caused by excessive heat. For example, the alignment projections 224 (FIG. 2) may experience less heat during operation.

Optionally, the movable contact 300 may be symmetrically-shaped. For example, as shown in FIG. 6, a first plane 360 extends through the center 342 and parallel to the Z axis and the Y axis. A second plane 362 extends through the center 342 and parallel to the Z axis and the X axis. The movable contact 300 is symmetrically-shaped with respect to each of the first and second planes 360, 362. More specifically, the portion of the movable contact 300 on one side of the first plane 360 is essentially symmetrical with respect to the portion of the movable contact 300 on the other side of the first plane 360. Likewise, the portion of the movable contact 300 on one side of the second plane 362 is essentially symmetrical with respect to the portion of the movable contact 300 on the other side of the second plane 362.

Figure 8:
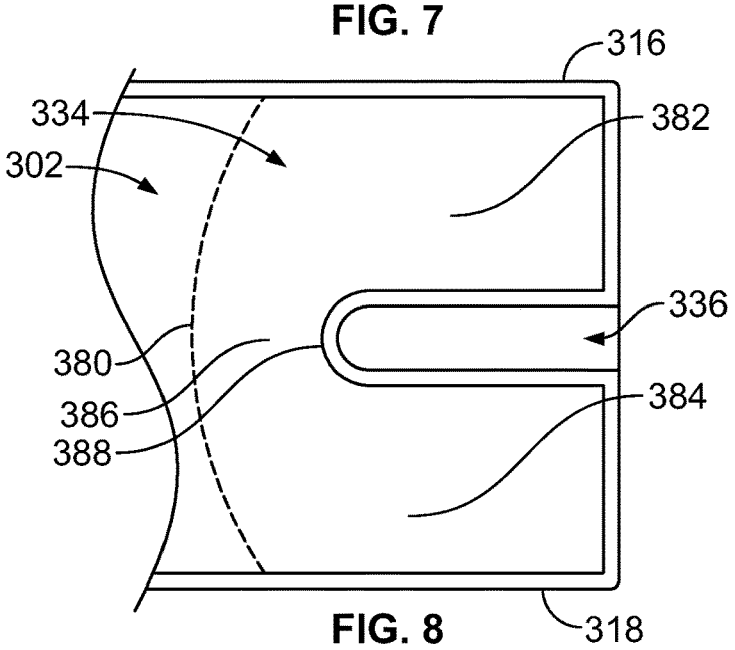
FIG. 8 is an enlarged view of a portion of the movable contact illustrating a contact zone in greater detail.

FIG. 8 is an enlarged view of a portion of the movable contact 300 illustrating the second contact zone 332 in greater detail. The following description may also be applicable to the first contact zone 330. A dashed line 380 represents a profile of the mating end when the mating end engages the second contact zone 332. The mating surface 334 includes a portion of the mating side 302 that engages the mating end of the stationary contact. Thus, the dashed line 380 represents a border of the mating surface 334. As shown, the dashed line 380 intersects the broad sides 316, 318. More specifically, the mating end is shaped to clear each of the broad sides 316, 318 such that the mating end extends beyond each of the broad sides 316, 318. In other embodiments, the mating end may not clear the broad side 316 and/or the broad side 318.

As shown, the recess 336 divides at least a portion of the mating surface 334. The recess 336 is a depression that extends only partially into the movable contact 300. The mating end of the stationary contact is configured (e.g., sized and shaped relative to the contact zone) to extend entirely across the recess 336 and engage the corresponding mating surface 334 on opposite sides of the recess 336. More specifically, the mating end may engage a first sub-area 382 and a second sub-area 384 that are on opposite sides of the recess 336. Optionally, the mating end may also engage a third sub-area 386. The third sub-area 386 represents a portion of the mating surface 334 that is not divided by the recess 336. The third sub-area 386 is positioned between the border 380 and an end 388 of the recess 336.

Figure 9:
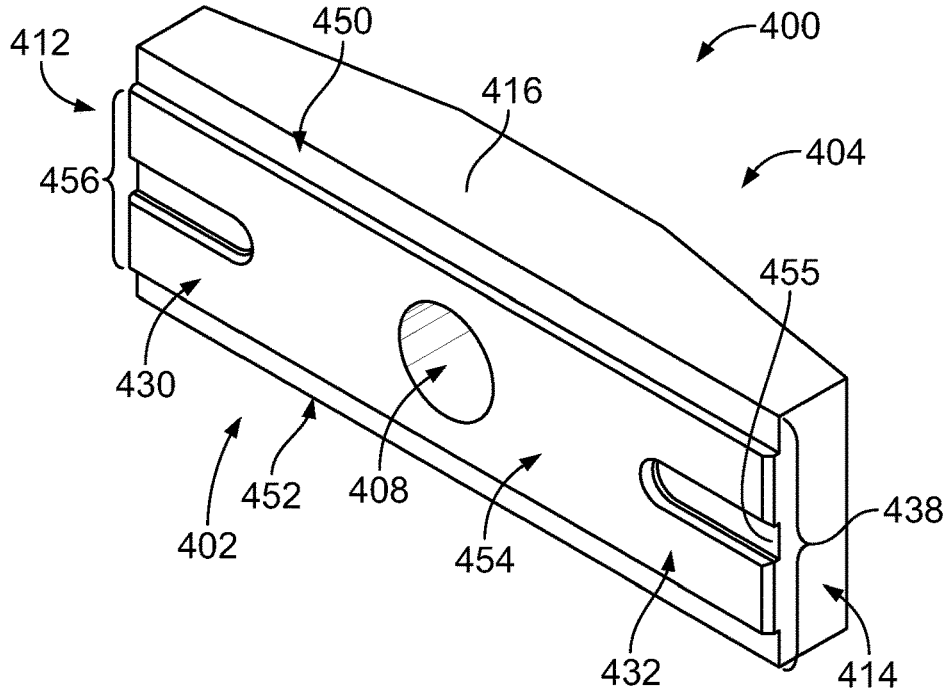
FIG. 9 is an isolated perspective view of a movable contact that may be used with the electromechanical switch of FIG. 1.
Figure 10:
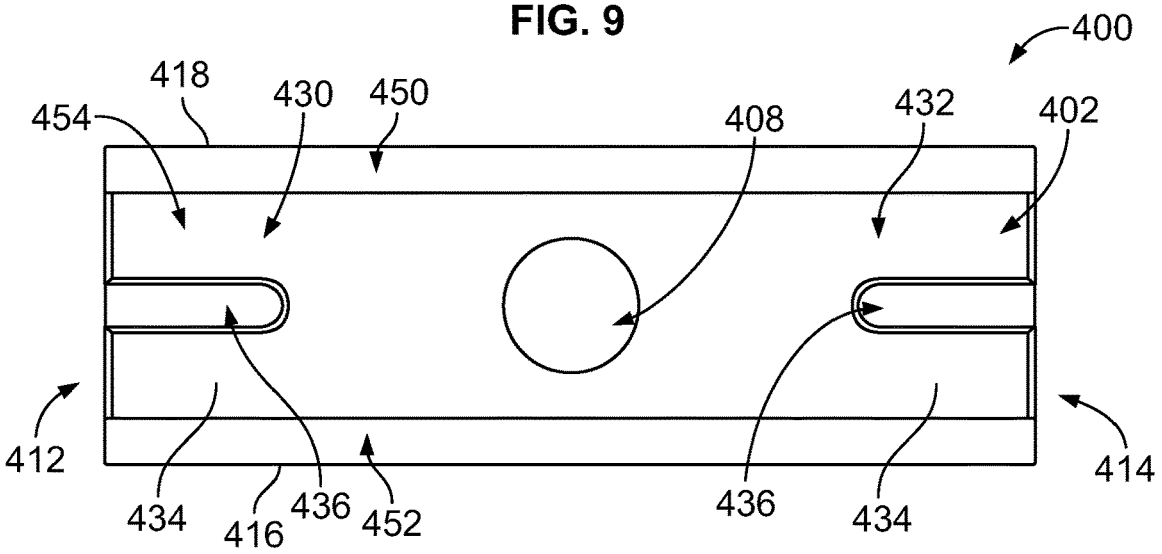
FIG. 10 is a top view of the movable contact of FIG. 9.
Figure 11:
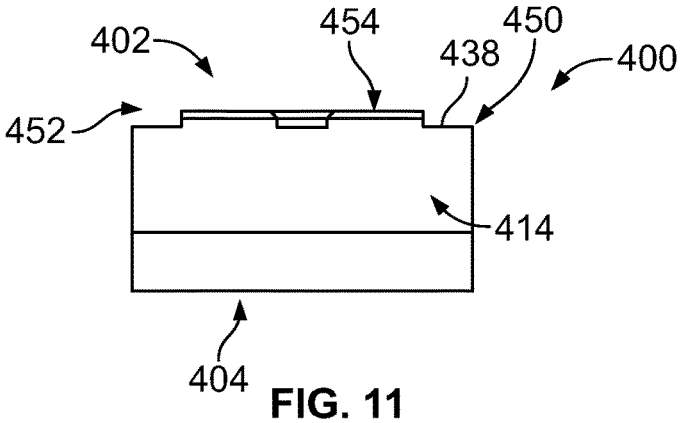
FIG. 11 is an end view of the movable contact of FIG. 9.

FIGS. 9-11 illustrate different isolated views of a movable contact 400 that may be used with the electromechanical switch 200 (FIG. 2). The movable contact 400 may include features that are similar or identical to features of the movable contact 300 (FIG. 4). For example, the movable contact 400 includes a mating side 402 and a mounting side 404. The mating side 402 is configured to engage and disengage stationary contacts, such as the stationary contacts 204, 206 (FIG. 2). The mating side 402 and the mounting side 404 face in generally opposite directions. The mounting side 404 is configured to receive a support rod, such as the support rod 210 (FIG. 2). More specifically, the mounting side 404 includes an opening (not shown) to a cavity 408 that receives the support rod. The cavity 408 may extend only partially through or entirely through the movable contact 400 as shown in FIGS. 9 and 10.

The mating side 402 has first and second contact zones 430, 432. The first and second contact zones 430, 432 are separate regions of the movable contact 400 that are configured to be covered by mating ends of corresponding stationary contacts. As shown, each of the first and second contact zones 430, 432 has a mating surface 434 and a corresponding recess 436 that divides at least a portion of the mating surface 434. Each of the mating ends of the stationary contacts is configured to extend entirely across the corresponding recess 436 and engage the corresponding mating surface 434 on opposite sides of the recess 436. The recess 436 has a depth 438 (FIG. 9 or FIG. 11) that extends only partially into the movable contact 400. In the illustrated embodiment, each of the recesses 436 is the only recess within the corresponding contact zone. It is contemplated, however, that the contact zones may include more than one recess (e.g., two or three recesses).

Also shown, the mating side 402 includes a pair of gutters 450, 452 and a platform surface 454 defined between the gutters 450, 452. In the illustrated embodiment, the platform surface 454 extends continuously across the mating side 402 between the first and second contact ends 412, 414. The platform surface 454 includes the first and second contact zones 430, 432. The platform surface 454 has a platform width 456 defined between the gutters 450, 452. The platform width 456 is less than a width 455 of the movable contact 400 that is defined between opposite broad sides 416, 418. The platform width 456 is sized relative to the respective mating ends such that the respective mating ends clear the platform surface 454 and extend over at least one of the gutters 450, 452.

Similar to the movable contact 300 (FIG. 4), the movable contact 400 may have a non-uniform thickness that is configured to provide more material toward a center of the movable contact.

It should be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and/or the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. An electromechanical switch comprising:

first and second stationary contacts, each of the first and second stationary contacts having a respective mating end; and a movable contact comprising a conductive material configured to transmit electrical power and having first and second contact zones, the first and second contact zones being separate regions of the movable contact that are operable to be covered by the respective mating ends of the first and second stationary contacts, respectively, each of the first and second contact zones having a mating surface and a corresponding recess that divides at least a portion of the mating surface, wherein each of the respective mating ends is configured to extend across the corresponding recess and engage the corresponding mating surface on opposite sides of the corresponding recess, the corresponding recess having a depth that extends only partially into the movable contact, the depth being defined between the mating surface and a bottom surface of the recess, wherein side surfaces of the recess and the bottom surface of the recess are formed by the conductive material.

2. The electromechanical switch of claim 1, wherein the movable contact includes opposite mating and mounting sides and first and second contact ends in which each of the mating and mounting sides extends between the first and second contact ends, the mating side including the first and second contact zones.

3. The electromechanical switch of claim 2, wherein the conductive material of the movable contact has a center of mass (COM) that is closer to the mounting side than the mating side.

4. The electromechanical switch of claim 2, wherein the conductive material has a thickness measured between the mating and mounting sides, the thickness of the conductive material being greater at a center of the movable contact, the conductive material causing the greater thickness configured to absorb thermal energy generated at the first and second contact zones.

5. The electromechanical switch of claim 2, wherein the movable contact further comprises opposite broad sides that extend between the first and second contact ends and between the mounting and mating sides, wherein the mounting side is shaped to center a mass of the movable contact.

6. The electromechanical switch of claim 2, wherein the respective mating ends of the first and second stationary contacts clear the first and second contacts ends, respectively, such that portions of the respective mating ends of the first and second stationary contacts do not cover the movable contact, wherein the respective mating end of the first stationary contact covers first and second sub-areas of the first contact zone that are on opposite sides of the recess of the first contact zone and covers a third sub-area that is not divided by the recess of the first contact zone, wherein the respective mating end of the second stationary contact covers first and second sub-areas of the second contact zone that are on opposite sides of the recess of the second contact zone and covers a third sub-area that is not divided by the recess of the second contact zone.

7. The electromechanical switch of claim 6, wherein less than half of each of the mating ends of the first and second stationary contacts covers the movable contact.

8. The electromechanical switch of claim 1, wherein the corresponding recess is the only recess that is entirely covered by the respective mating end.

9. The electromechanical switch of claim 1, wherein the corresponding recess of the first contact zone opens to a first contact end of the movable contact and the corresponding recess of the second contact zone opens to a second contact end of the movable contact.

10. The electromechanical switch of claim 1, wherein each of the recesses is the only recess that divides the respective mating surface.

11. The electromechanical switch of claim 1, wherein a plane extends between the first and second contact zones and a center of the movable contact, the recesses being aligned with the plane and the center of the movable contact.

12. The electromechanical switch of claim 1, wherein a plane extends between the first and second contact zones and a center of the movable contact, the plane coinciding with and dividing each of the recesses such that a portion of the recess on one side of the plane is essentially symmetrical with a portion of the recess on the other side of the plane.

13. An electromechanical switch comprising:

first and second stationary contacts, each of the first and second stationary contacts having a respective mating end: and a movable contact having first and second contact zones, the first and second contact zones being separate regions of the movable contact that are operable to be covered by the respective mating ends of the first and second stationary contacts, respectively, each of the first and second contact zones having a mating surface and a corresponding recess that divides at least a portion of the mating surface, wherein each of the respective mating ends is configured to extend across the corresponding recess and engage the corresponding mating surface on opposite sides of the corresponding recess, the corresponding recess having a depth that extends only partially into the movable contact:

wherein the movable contact includes opposite matin; and mounting sides and first and second contact ends in which each of the mating and mounting sides extends between the first and second contact ends, the mating side including the first and second contact zones;

wherein the mating side includes a pair of gutters and a platform surface defined between the gutters, the platform surface including the first and second contact zones.

14. The electromechanical switch of claim 13, wherein the platform surface has a platform width defined between the gutters, the platform width being sized relative to the respective mating ends such that the respective mating ends clear the platform surface and extend over at least one of the gutters.

15. The electromechanical switch of claim 13, wherein the platform surface extends continuously across the mating side between the first and second contact ends.

16. A power circuit comprising:

an electromagnetic driving unit;

a switch operably coupled to the electromagnetic driving unit; and an electromechanical switch comprising first and second stationary contacts and a movable contact, each of the first and second stationary contacts having a respective mating end, the movable contact comprising a conductive material configured to transmit electrical power and having first and second contact zones, the first and second contact zones being separate regions of the movable contact that are operable to be covered by the respective mating ends of the first and second stationary contacts, respectively, the movable contact including opposite mating and mounting sides and also including first and second contact ends in which each of the mating and mounting sides extends between the first and second contact ends, the mating side including the first and second contact zones;

wherein each of the first and second contact zones has a corresponding mating surface and a corresponding recess that divides at least a portion of the corresponding mating surface, wherein each of the respective mating ends is configured to extend across the corresponding recess and engage the corresponding mating surface on opposite sides of the corresponding recess, the corresponding recess having a depth that extends only partially into the movable contact, the depth being defined between the mating surface and a bottom surface of the recess, wherein side surfaces of the recess and the bottom surface of the recess are formed by the conductive material; and wherein the switch is operably coupled to the movable contact, the electromagnetic driving unit operable to move the switch between at least two different positions to connect and disconnect a power supply.

17. The power circuit of claim 16, wherein the conductive material of the movable contact has a center of mass (COM) that is closer to the mounting side than the mating side.

18. The power circuit of claim 16, wherein the conductive material has a thickness measured between the mating and mounting sides, the thickness of the conductive material being greater at a center of the movable contact the conductive material causing the greater thickness configured to absorb thermal energy generated at the first and second contact zones.

19. The power circuit of claim 16, wherein the mating side includes a pair of gutters and a platform surface defined between the gutters, the platform surface including the first and second contact zones.

20. The power circuit of claim 19, wherein the platform surface has a platform width defined between the gutters, the platform width being sized relative to the respective mating ends such that the respective mating ends clear the platform surface and extend over at least one of the gutters.

* * * * *